US006842188B2

(12) United States Patent
Iannazzi

(10) Patent No.: US 6,842,188 B2
(45) Date of Patent: Jan. 11, 2005

(54) METHOD FOR SETTING FOCUS OF A MULTICHANNEL PRINTHEAD

(75) Inventor: Craig Iannazzi, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/439,539

(22) Filed: May 16, 2003

(65) Prior Publication Data

US 2004/0227803 A1 Nov. 18, 2004

(51) Int. Cl.[7] ..... B41J 15/14
(52) U.S. Cl. ..... 347/241
(58) Field of Search ..... 347/14, 15, 19, 347/23, 43, 241, 245, 177, 234, 237, 262; 430/200; 346/134; 355/56, 30, 77

(56) References Cited

U.S. PATENT DOCUMENTS

| | | | | |
|---|---|---|---|---|
| 4,937,620 | A | 6/1990 | Ozawa et al. | 355/77 |
| 5,138,497 | A | 8/1992 | Blanding | 359/823 |
| 5,268,708 | A | 12/1993 | Harshbarger et al. | 346/134 |
| 5,428,371 | A | 6/1995 | Fox et al. | 347/262 |
| 5,754,275 | A | 5/1998 | Takeda | 355/30 |
| 6,232,999 | B1 | 5/2001 | Kerr et al. | 347/241 |
| 2002/0131029 | A1 | 9/2002 | Uchiyama | 355/56 |

*Primary Examiner*—K. Feggins
(74) *Attorney, Agent, or Firm*—Nelson Adrian Blish

(57) ABSTRACT

A method for setting focus of a multichannel printhead for an imaging apparatus (10) comprises moving the printhead (500) to a premove position. A first set of patches (82) is printed wherein a focus position of the printhead is varied in a first random pattern from one patch to another. A second set of patches (83) is printed wherein the focus position of the printhead is varied in a second random pattern from one patch to another. A density for each of the patches is measured in the first series of patches. A density for each of the patches is measured in the second series of patches. An optimum focus position is calculated for the multichannel printhead based on a polynomial curve (72) of density and focus position for each of the patches.

3 Claims, 5 Drawing Sheets

METHOD FOR SETTING FOCUS OF A MULTICHANNEL PRINTHEAD

FIELD OF THE INVENTION

The presented invention relates to a method for focusing a laser thermal printhead and more specifically imaging a randomized focus pattern and measuring the resulting density to calculate a focus position.

BACKGROUND OF THE INVENTION

Color proofing is a process used by the printing industry to simulate proofs generated on a press run. By using color proofing the printing industry saves time and money simulating how the press will look before the costly press run is performed. The advantage of a color proof is that it is a representation of an ideal press run. The color proof should reflect exactly what the printing industry would like to see coming off a press. The press is continually adjusted to match the color of the proof. The color proof therefore needs to be precise color, reproducible from proofer to proofer, and pre-press shop to pre-press shop. Proofs that exhibit color variation are deemed unacceptable.

One commercially available image processing apparatus, which is depicted in commonly assigned U.S. Pat. No. 5,428,371, is an image processing apparatus having half-tone color proofing capabilities. This image processing apparatus is arranged to form an intended image on a sheet of thermal print media by transferring dye from a sheet of dye donor material to the thermal print media by applying thermal energy to the dye donor material, to transfer dye to the thermal print media, thereby forming an intended image. This image processing apparatus is comprised generally of a material supply assembly or carousel, lathe bed scanning subsystem (which includes a lathe bed scanning frame, translation drive, translation stage member, printhead, and vacuum imaging drum), and thermal print media and dye donor material exit transports.

The operation of the image processing apparatus comprises feeding a sheet of thermal media from the media roll to the vacuum drum, partially wrapped around the drum, cut to length, then wrapped fully around the drum. A length of dye donor from a roll form is similarly transported to the drum, partially wrapped around the drum, cut to a desired length, then fully wrapped around the vacuum drum. The dye donor material is wrapped around the vacuum imaging drum, such that it is superposed in registration with the thermal print media. The translation drive, part of the scanning subsystem, traverses the printhead and translation stage member axially along the vacuum imaging drum in coordinated motion with the rotating vacuum imaging drum to produce the intended image on the thermal print media.

The printhead includes a plurality of laser diodes which are coupled to the printhead by fiber optic cables which can be individually modulated to supply energy to selected areas of the donor in accordance with an information signal. The printhead includes a plurality of optical fibers coupled to the laser diodes at one end and at the other end to a fiber optic array within the printhead. The printhead moves relative to the longitudinal axis of the vacuum imaging drum and dye is transferred to the thermal print media as the radiation, transferred from the laser diodes by the optical fibers to the printhead to the dye donor material, is converted to thermal energy in the dye donor material.

Color variation is typically a result of variation of the individual color density used to define to desired color.

There are many factors that influence the density variation of a color in a proof. One factor that influences proof density uniformity is the focus position of a printhead. Focus is defined by the distance between the lens and the imaging plane along the optical axis. There exists an optimum distance between the imaging plane and the end of the lens for maximum density transfer. As the focus position varies from the optimum position density will also vary. The relationship between focus position and density is often parabolic in nature. As the actual focus position moves away from the theoretical best focus position the density will vary exponentially.

Several factors contribute to focus related errors. Some existing color proofs, for example U.S. Pat. No. 5,428,371, use a translation system to move the printhead across the imaging plane. Without perfect alignment of translation components an optical axis distance error will be introduced. Thermal media used on color proofing systems have some level of thickness variability. Thickness variation is typically highest in the same direction as the proofer translation. Choices of hardware to position the printhead in the optical axis direction influence the ability to place the printhead to a desired position. Environmental effects, specifically changes in temperature, can introduce optical axis distance changes and instability of a focus position.

Some early digital proofers, such as U.S. Pat. No. 5,268,708 utilized an auto focus system to detect changes in optical axis distance due to drum and rod alignment and media thickness changes. This system used a reflected laser to measure distance changes. Disadvantages of this system include the presence of unwanted noise which did not allow the system to work properly. The system was also damaged frequently and was costly to replace. This lead many service engineers to simply disconnect the auto-focus device, essentially leaving the system as a fixed-focus system.

One color proofing system uses a fixed focus design. The system is designed to allow acceptable print uniformity at a optimum focus position. The best focus patch is determined by selection of patches for a course adjustment proof and then a fine adjustment proof. The course and fine focus proofs are written in a similar manner. A single linear ramp of focus positions is imaged across the translation direction. The best patch is defined as the patch with maximum density. This patch selection method leads to several disadvantages.

Using a method of printing patches to determine the best focus position introduces errors due to print noise as well as errors due to selecting a single patch, rather than interpreting between patches. The best focus position is essentially limited in accuracy to the focus step size of the fine adjustment proof. Print noise comes from various sources. One error as previously started is changes in focus position. Another error is coating quality of thermal media, both receivers and donors. Coating non-uniformities typically are seen in the same direction as the translation system of the proofer. Errors arrive from optical noise and fiber optic blooming as a result of moving fiber optic cables during the printing process as well as variability within lasers and laser power supplies. A densitometer or spectrophotometer used to measure patches introduces random density errors. Without using statistical methods to find the optimum focus position results will exhibit unacceptable amounts of error.

SUMMARY OF THE INVENTION

Briefly summarized, according to one aspect of the present invention, a method for setting focus of a multichannel printhead for an imaging apparatus comprises moving the printhead to a premove position. A first set of patches is printed wherein a focus position of the printhead is varied in a first random pattern from one patch to another. A second set of patches is printed wherein the focus position of the printhead is varied in a second random pattern from one patch to another. A density for each of the patches is measured in the first series of patches. A density for each of the patches is measured in the second series of patches. An optimum focus position is calculated for the multichannel printhead based on a polynomial curve of density and focus position for each of the patches.

According to one embodiment of a series of test patches covering the range of mechanical motion of the printhead focus device and arranged in a linear ramp are first printed as a coarse adjustment. The patch corresponding to the maximum density is chosen as the best coarse focus position. Next, a series of randomly focused patches are imaged in order to locate the optimum focus position. The randomized nature of the data points, the distance the points cover, and the number of points are used in order to gain high accuracy with the presence of many noise sources. The fine adjustment proof is designed to be scanned in allowing for polynomial interpolation between patches for precise location of the optimum focus position.

An advantage of the present invention is increased accuracy in locating the best average focus position of a printhead.

An advantage of the present invention is that the best focus position is not limited to a patch choice. Interpolation allows for a focus position to be determined between patches.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
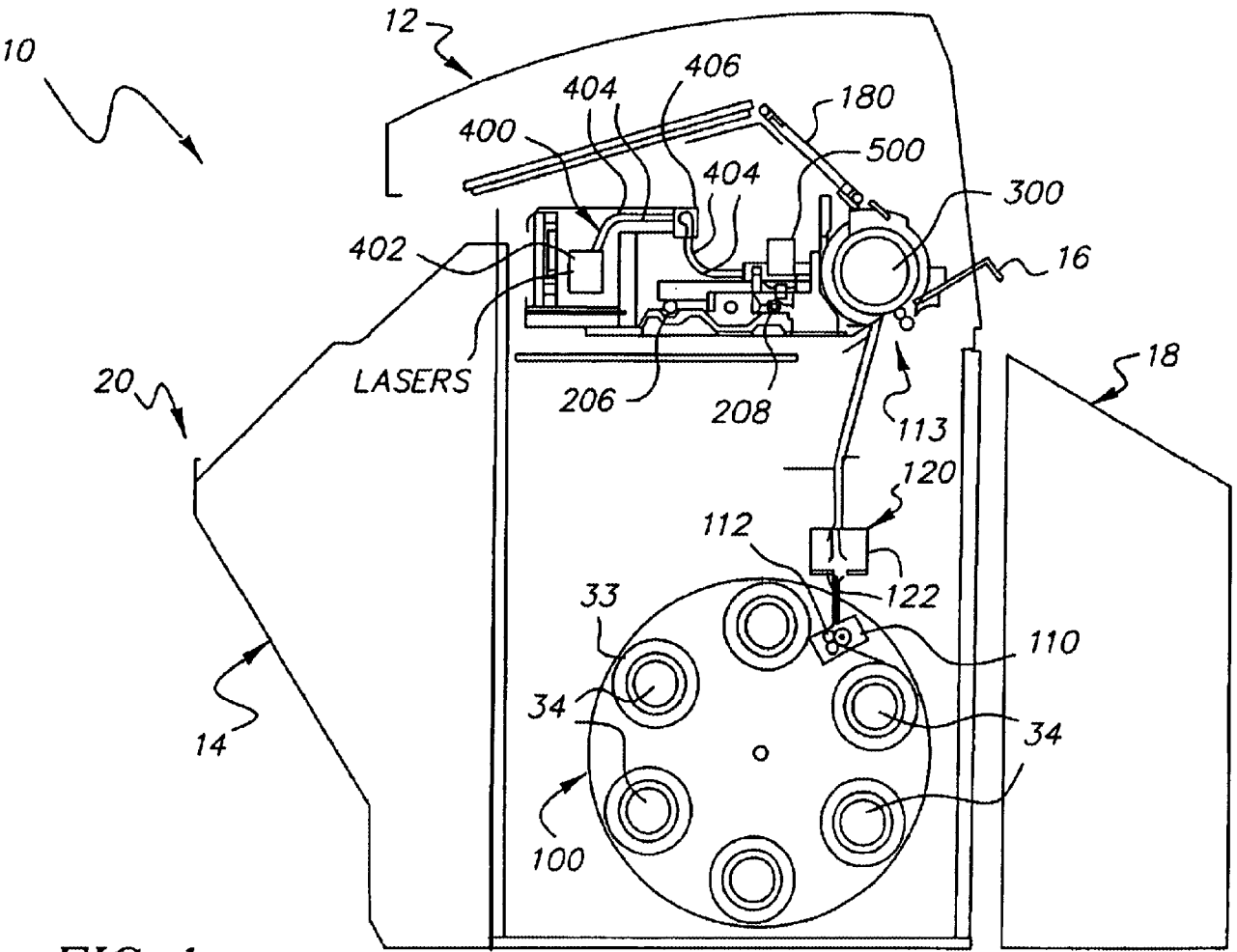
FIG. 1 is a side view and vertical cross-section of an image processing apparatus of the present invention.

Referring to FIG. 1, there is illustrated an image processing apparatus according to the present invention having an image processor housing 12 which provides a protective cover. A movable, hinged image processor door 14 is attached to the front portion of image processor housing 12 permitting access to a media carousel 100. A roll of donor roll material 34 is connected to a media carousel 100 in a lower portion of image processor housing 12. Up to seven rolls of roll media can be used. One roll of media 33 is thermal print media used to transfer the donor material 34 onto. This thermal print media 33 is passed to vacuum imaging drum 300 and is ultimately cut into donor sheet material (not shown). In this regard, a media drive mechanism 110 is attached to the thermal print media 33, and includes three media drive rollers 112 through which the thermal print media 33 of interest is metered upwardly into a media knife assembly 120. After thermal print media 33 reaches drum load roller 113, media drive rollers 112 cease driving the donor roll material 34 and two media knife blades 122 positioned at the bottom portion of media knife assembly 120 cut the thermal print media 33 into thermal print media (not shown). Drum load roller 113 presses the cut thermal print media against the vacuum imaging drum 300 while the vacuum imaging drum 300 slowly rotates the cut media (not shown) around vacuum imaging drum 300.

Each remaining roll of donor material 34 is a different color, typically black, yellow, magenta and cyan. These donor roll materials 34 are passed to vacuum imaging drum 300 and are ultimately cut into donor sheet materials (not shown) for forming the medium from which colorant imbedded therein are passed to thermal print media resting thereon, which process is described in detail below. In this regard, a media drive mechanism 110 is attached to each roll media of donor roll material 34, and includes three media drive rollers 112 through which the donor roll material 34 of interest is metered upwardly into a media knife assembly 120. After donor roll material 34 reaches drum load roller 113, media drive rollers 112 cease driving the donor roll material 34 and two media knife blades 122 positioned at the bottom portion of media knife assembly 120 cut the donor roll material 34 into donor sheet materials (not shown). Drum load roller 113 presses the cut media against the vacuum imaging drum 300 while the vacuum imaging drum 300 slowly rotates the cut media (not shown) around vacuum imaging drum 300. The donor sheet material now rests atop the thermal print media (not shown) with a narrow space between the two created by microbeads embedded in the surface of the thermal print media.

A laser assembly 400 includes a quantity of laser diodes 402 in its interior. Laser diodes 402 are connected via fiber optic cables 404 to a distribution block 406 and ultimately to printhead 500. Printhead 500 directs thermal energy received from laser diodes 402 causing the donor sheet material to pass the desired colorant across the gap and onto the thermal print media (not shown).

In operation, vacuum imaging drum 300 rotates at a constant velocity. Printhead 500 begins at one end of the thermal print media and traverses the length of the thermal print media, transferring dye for a particular donor sheet material resting on the thermal print media. After printhead 500 has completed the transfer process, for the donor sheet material resting on the thermal print media the donor sheet material is then removed from the vacuum imaging drum 300 and transferred out of image processor housing 12 via a skive or donor ejection chute 16. The donor sheet material eventually comes to rest in a donor waste bin 18 for removal by the user. The process is then repeated for the other desired rolls of donor roll media 34.

After the color from all desired sheets of the donor materials have been transferred and the donor sheet materials have been removed from vacuum imaging drum 300, the thermal print media is removed from vacuum imaging drum 300 and transported via a transport mechanism 180 to a exit tray (not shown). Thermal print media is then laminated to a paper stock using a Kodak 800XL laminator.

Figure 2:
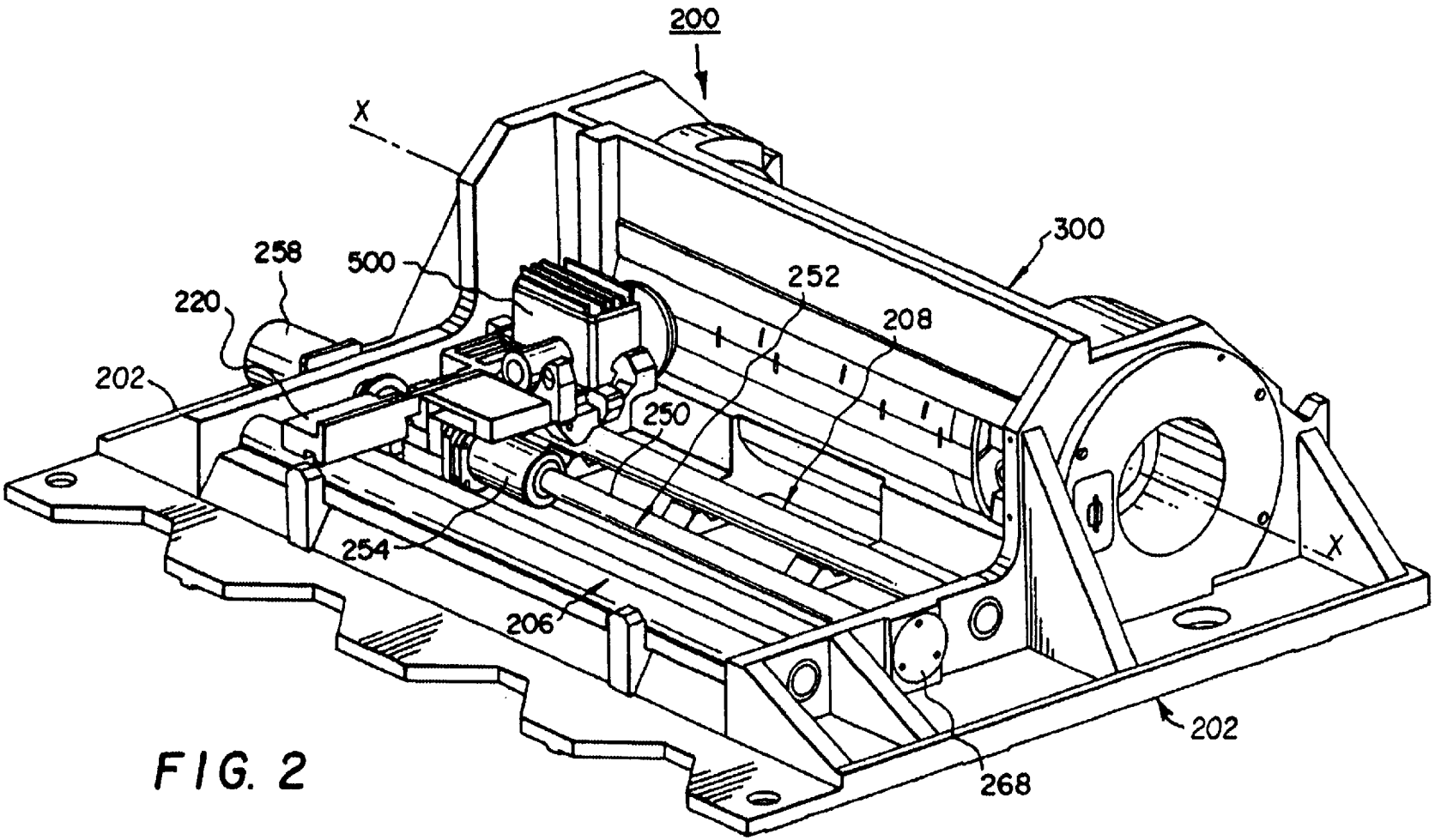
FIG. 2 is a perspective view of the lathe bed scanning subsystem of the present invention viewed from the rear of the image processing apparatus.

Referring to FIG. 2, show a perspective view of lathe bed scanning subsystem 200 of image processing apparatus 10, including vacuum imaging drum 300, printhead 500, and lead screw 250 assembled in lathe bed scanning frame 202. Printhead 500 is attached to a lead screw 250 via a lead screw drive nut 254 and a drive coupling (not shown) for moving the printhead along the longitudinal axis of vacuum imaging drum 300 for transferring the dye to create the intended image onto the thermal print media 33.

Vacuum imaging drum 300 is mounted for rotation about an axis X in lathe bed scanning frame 202. Printhead 500 is movable with respect to vacuum imaging drum 300, and is arranged to direct a beam of light to the donor sheet material. The beam of light from printhead 500 for each laser diode 402 (not shown in FIG. 2) is modulated individually by modulated electronic signals from image processing apparatus 10, which are representative of the shape and color of the original image, so that the color on the donor sheet material is heated to cause volatilization only in those areas in which its presence is required on the thermal print media 33 to reconstruct the shape and color of the original image.

Translation

Printhead 500 is mounted on a movable translation stage member 220 which, in turn, is supported for low friction slidable movement on translation bearing rods 206 and 208. Translation bearing rods 206 and 208 are sufficiently rigid so as not to sag or distort as is possible between their mounting points and are arranged to be as parallel as possible with axis X of vacuum imaging drum 300 with the axis of printhead 500 perpendicular to the axis X of vacuum imaging drum 300. Front translation bearing rod 208 locates translation stage member 220 in the vertical and the horizontal directions with respect to axis X of vacuum imaging drum 300. Rear translation bearing rod 206 locates translation stage member 220 only with respect to rotation of translation stage member 220 about front translation bearing rod 208 so that there is no over-constraint condition of translation stage member 220 which might cause it to bind, chatter, or otherwise impart undesirable vibration or jitters to printhead 500 during the generation of an intended image.

Writing

Printhead 500 travels in a path along vacuum imaging drum 300, while being moved at a speed synchronous with the vacuum imaging drum 300 rotation and proportional to the width of a writing swath (not shown). The pattern that printhead 500 transfers to the thermal print media 33 along vacuum imaging drum 300 is a helix.

Focus Motor

Figure 3:
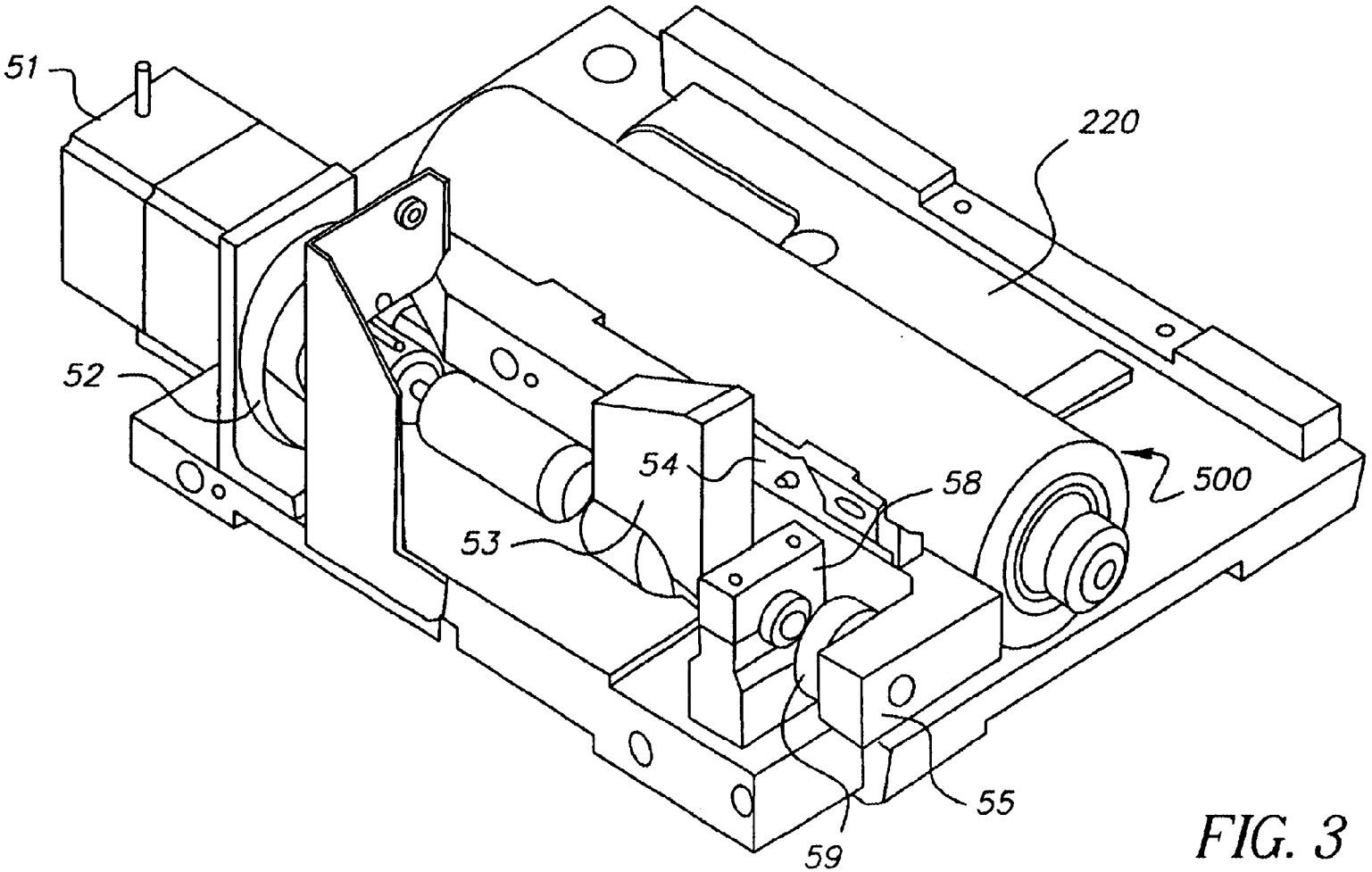
FIG. 3 shows a perspective view of the printhead and support components.

Referring to FIG. 3, a focus motor 51 mounted against a mounting block provides linear movement needed to focus the printhead 500. In the preferred embodiment, focus stepper motor acts as a linear actuator, effecting linear movement by incrementing its shaft forward or backwards with each motor step. The preferred embodiment uses a model no. 110702 (417-11-19-13 0.46A) linear actuator with a 22k gear box manufactured by Lin Engineering. This device provides 0.07215 microns linear movement per motor step.

An important characteristic of the stepper motor is the relationship of the driving phase currents that cooperate to rotate the motor. The phase state relationship of currents that drive the stepper motor which energize different windings in the stator at each successive phase state, gives the rotor shaft only a finite number of possible angular positions. It is this capability that allows the stepper motor to run "open-loop," that is, without encoder feedback, to achieve a precisely known angular position when driven using a precise number of steps. Once a fixed reference home position is established, the stepper motor provides a precise rotation, which can then be mechanically translated to provide precise linear movement, using techniques well-known in the art.

The focus motor is controlled in increments of four steps to provide repeatable positioning. The resolution is therefore reduced to 0.2886 um per four motor steps.

Movement of the Printhead

The printhead 500 is mounted in place on the translation stage member 220 and is moved forwards and backwards by action of the focus stepper motor 51. The focus stepper motor 51 connects to a micrometer 53 which is connected to a mounting block 58. The model of the micrometer is 350-712-30 manufactured by Mitotoyo Corporation. The micrometer attaches to a printhead clamp 55 by a magnetic couple 59. The printhead is held in place using magnetic force and v shaped blocks. Teflon pads are attached to the top of the magnets providing low friction necessary for forwards and backwards motion. Motor torque of the focus stepper motor 51 is large enough to overcome the magnetic force provided by the magnets mounted in the V grooves.

Printhead Focus Home

Two types of flags with associated light emitting sensors are used for determining focus home. A linear flag 54 is attached to the printhead mounting bracket. A rotary flag 52 is attached to the stepper motor. Sensors are positioned to detect each flag. The linear focus home sensor and the rotary focus home sensor are standard optical sensors type 1A05HR, manufactured by sharp Electronics Corporation. Focus home sensors have a conventional emitter-receiver leg configuration well-known in the art. The mounted position of the focus home linear sensor allows for clear passage of the focus home linear flag 54 between the legs of the sensor. The mounted position of the focus home rotary sensor allows for clear passage of the focus home rotary flag 52 between the legs of the sensor.

First installation and use of the printhead requires the linear flag 54 and rotary flag 52 positions to be set up. To do this the micrometer 53 is set to a mechanical zero position and the readout is set to 0 mm. The printhead 500 is then moved such that the micrometer 53 readout is 6.750 mm. The best method to move the printhead 500 is by rotating the coupling magnet 59 attached to the micrometer 53. The linear flag 54 is then positioned such that the light emitted from the linear flag sensor is just blocked. The rotary flag 52 is then adjusted such that the flag notch is in the center of the rotary home flag sensor.

The homing procedure requires the printhead 500 to travel away from the vacuum drum until the linear flag 54 interrupts emitted light from a focus home linear sensor. The printhead 500 continues in traveling until the rotary flag 52 blocks light emitted from the focus home rotary flag sensor. The printhead 500, then travels towards the vacuum drum until the focus home rotary sensor becomes unblocked. All positions requests will move the printhead 500 towards the vacuum drum. The focus drive system is always driven in one direction to remove effects of backlash, or system slack.

A pre-move operation of the focus system is performed which consists of homing the printhead 500, moving out to the best focus position if available, or a preset position, re-homing the printhead 500, moving back out to the best focus position if available, or a preset position, and finally re-homing the printhead 500. This operation allows the printhead 500 to break free of any time induced static friction.

Focus Test Proofs

Figure 4:
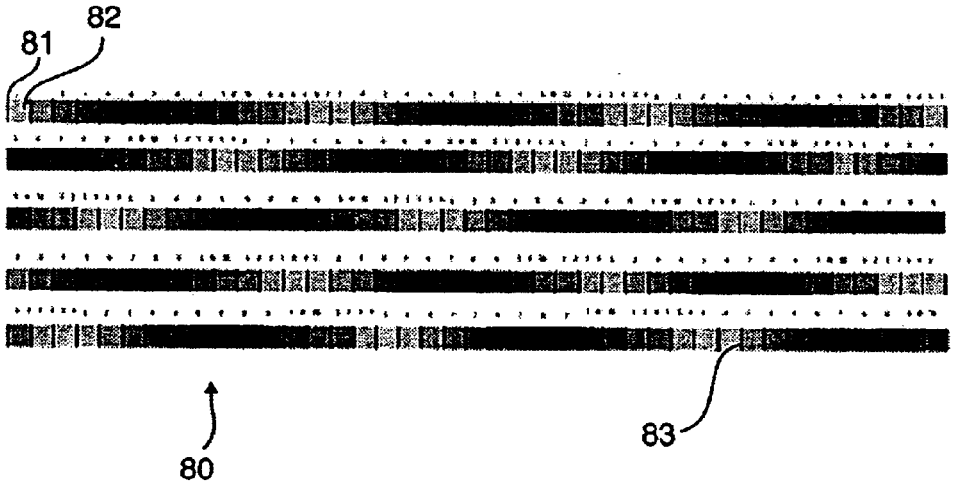
FIG. 4 shows a representation of a fine focus adjustment proof

The process for location an optimum focus position requires two test proofs to be written. The first proof is a coarse adjustment proof, while the second test proof is a fine adjustment proof 80 seen in FIG. 4.

Coarse Focus Proof

Obtaining a coarse focus position accomplished by imaging a set of 25 solid patterns, each at a predetermined focus motor 51 step count and starting position in reference to the focus home position. The course focus step count is setup such that the distance traveled is maximized between mechanical hard stops for the desired number of patches. The exact sequence of events is to execute a pre-move, load thermal print media 33 and dye donor roll material 34, position the printhead 500 in front of the thermal receivers on the vacuum imaging drum 300, position the printhead 500 focus to home, turn the focus motor 51 off to avoid building up of heat, image a solid test patch at predetermined exposure, move the translation system over to provide a small gap between patches, focus home the printhead 500, move the printhead focus to 464 steps away from home, image the solid test pattern. This process is repeated such that a series of 25 patches is written. This will create a 25 patch sequence with focus changes of 33.5 um per patch. The user will select the darkest patch from the series of coarse focus patches. A software interface stores the best course focus value and will center the fine focus adjustment proof 80 around the best course focus position. See FIG. 4.

Fine Focus Proof

Obtaining a final focus position involves imaging a fine focus adjustment proof 80. This proof uses at least one row of density patches 82 written with different focus positions and at most 5 rows of density patches written with different of focus positions. Each row 81 consists of 40 patches. There are a maximum of 200 fine focus patches.

Focus position for each patch 82 are pseudo-randomized in the translation direction for each row 81. The pseudo-randomized pattern was developed using a randomize function on a equal step ramp of focus position requests. The randomized focus positions are then used to create a pseudo-randomized pattern, essentially a static random pattern.

The range of distance the fine focus patches cover is centered around the best coarse focus position. Focus distances will not exceed two coarse focus patch distances or 67 um. Each focus position is imaged resulting in density. An important feature of the fine focus proof is that there are no duplicate focus position requests located in the same y-axis direction (drum travel direction).

The fine focus proof is designed to be densitometered using a scanning spectrophotometer Model number DTP-41 manufactured by X-Rite. The relatively small distance range of focus positions on the fine focus proof causes the patches 82 to appear to be similar density, and with the randomized nature of the proof, a user will not be able to manually select a patch 82. In addition, measuring many patches by hand is time consuming and can lead to user induced error. The X-Rite DTP41 scanning spectrophotmeter requires a minimum level of patch 82 to patch 82 contrast in order to recognize and process the requested pattern. 14 mm patches 82 containing density produced by a desired focus position can range from 0.5 density to 1.7 density. Levels beyond 0.5 to 1.7 are rejected. As stated there is little patch 82 to patch 82 density variation. Imaging 0.7 mm patches 83 between desired patches 82 at a high exposure allows for the necessary contrast required for DTP41 measurement by exceeding the exposure level for maximum density output.

A printhead 500 pre-move is issued before writing the fine focus proof 80 to eliminate any time induced static friction. For each fine focus patch 82 the printhead 500 is homed then sent to the requested position. After the printhead 500 is positioned the focus motor 51 is turned off to reduce heat buildup.

Density Processing

Densities are read in using a software density interface. The number of rows 81 imaged on the fine focus proof 80 will correlate to the number of rows 81 to be scanned. The fine focus proof 80 is laminated onto a paper stock using the Kodak XL-800 laminator, then cut to allow clearance for the scanning spectrophotometer and fed through the scanning densitometered. An arrow is located on the fine focus proof 80 indicating the direction to feed the fine focus proof 80 into the scanning spectrophotometer. A save and a close button is located at the bottom of the density entry window. Pressing save then close allows for processing of entered density and calculation of the best focus position.

To avoid unpredictable results, focus data points below 0.5 density and above 1.7 density are eliminated. Also a check for outlier data is performed by fitting a 2-degree polynomial to the data and removing points more than three standard deviations away from the polynomial curve fit.

Figure 5:
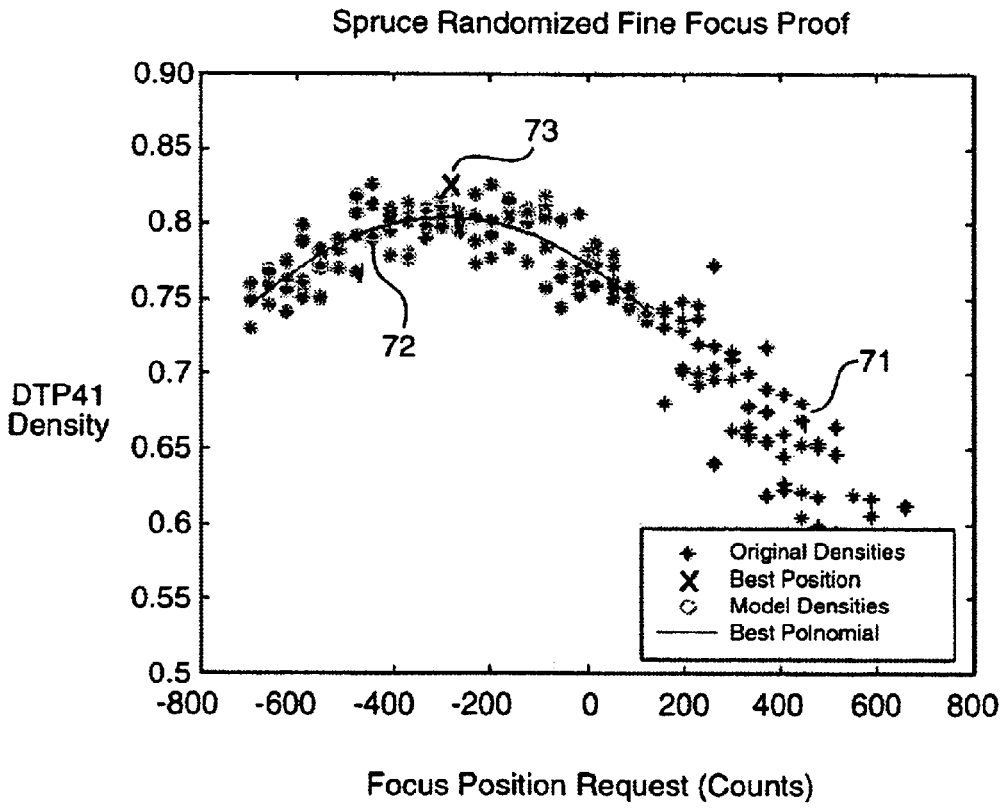
FIG. 5 shows an example of densities resulting from a fine focus proof.

As shown in FIG. 5, to calculate the best focus position, polynomials 72 are formed for every focus position request and resulting density data 71 set that encompasses 60 microns of focus (z-axis) distance. The best focus position for each curve is calculated by locating the focus position at the peak of the 2-degree polynomial 72. For each 60 um data set the distance from the calculated best focal position to the center position of the 60 um data set is calculated. The data set that has a minimized distance between the best calculated focus position and the center of the 60 um data set is used to determine the final best focus position 73. Polynomial 72 is essentially centered around the best focus position. The final calculated focus position is the closest position to the calculated best focus position that is divisible by four. This quantization is necessary due to the quad step nature of the focus stepper motor 51. The best focus position is stored in the computer registry.

A check that the calculated focus position 73 is performed to guarantee the calculated focus position 73 exists in the range of distance that the fine focus proof 80 covers. The final step is to position the printhead 500 to the calculated focus position.

The randomization of patches, the number of patches, the range of distance for the patches, and the offset for each row of patches are all necessary to calculate an accurate focus position given different noises in the proofing system. Noises present in the proofing system include thermal media coating variability, lamination variability, spectrophotometer measurement variability, environmental effects on thermal media, positional repeatability of the focus system, distance changes between the printhead 500 and the vacuum imaging drum 300 in the printhead translation direction of the proofing system, optical noise, and distance changes between the printhead 500 and the full circumference of the vacuum imaging drum 300.

The invention has been described in detail with particular reference to certain preferred embodiments thereof, but it will be understood that variations and modifications can be effected within the scope of the invention.

PARTS LIST

10 Image processing apparatus
12 Image processor housing
14 Image processor door
16 Donor ejection chute
18 Donor waste bin
33 Thermal print media
34 Donor roll material
51 Focus stepper motor

52 Rotary flag
53 Micrometer
54 Linear flag
55 Printhead clamp
58 Mounting block
59 Magnetic couple
71 Resulting density data
72 Polynomial
73 Focus position
80 Fine focus adjustment proof
81 Row
82 Patch
83 Patch
100 Media carousel
110 Media drive mechanism
112 Media drive roller
113 Drum load roller
120 Media knife assembly
122 Media knife blades
180 Transport mechanism
300 Vacuum imaging drum
400 Laser assembly
402 Laser diodes
404 Fiber optic cables
406 Distribution block
500 Printhead

What is claimed is:

1. A method for setting focus of a multichannel printhead for an imaging processing apparatus comprising:

moving said printhead to a premove position;

printing a first set of patches wherein a focus position of said printhead is varied in a first random pattern from one patch to another;

printing a second set of patches wherein said focus position of said printhead is varied in a second random pattern from one patch to another;

measuring a density for each of said patches in said first series of patches;

measuring a density for each of said patches in said second series of patches;

calculating an optimum focus position for said multichannel printhead based on a polynomial curve of density and focus position for each of said patches; and wherein density and focus position outside a predetermined distance from said polynomial curve are deleted prior to calculating said optimum focus position.

2. A method as in claim 1 comprising:

printing a third set of patches wherein said focus position of said printhead is varied in a third random pattern from one patch to another;

measuring a density for each of said patches in said third series of patches; and calculating said optimum focus position for said multichannel printhead.

3. A method as in claim 1 wherein said calculation is a least squares method.

* * * * *